US005080602A

United States Patent [19]

Lee Chao

[11] Patent Number: 5,080,602

[45] Date of Patent: Jan. 14, 1992

[54] ELECTRICAL CONNECTOR FOR EXERTING MULTIPLE ELASTIC FORCES

[76] Inventor: Kuei L. Lee Chao, C/O Hung Hsing Patent Service Center, P. O. Box 55-1670, Taipei, Taiwan

[21] Appl. No.: 656,213

[22] Filed: Feb. 15, 1991

[51] Int. Cl.[5] ..... H01R 13/00

[52] U.S. Cl. ..... 439/326

[58] Field of Search ..... 439/296, 326, 629-637

[56] References Cited

U.S. PATENT DOCUMENTS 4,737,120 4/1988 Grabbe et al. ..... 439/326

5,004,429 4/1991 Yagi et al. ..... 439/326

5,013,257 5/1991 Korsunsky et al. ..... 439/326

*Primary Examiner*—Joseph H. McGlynn

[57] ABSTRACT

An electrical connector includes a contact element formed with a main spring arm member protruding inwardly from a side engaging member of the contact element embedded in a slot formed in a connector base of the electrical conenctor defining a bow portion between the main spring arm member and the side engaging member for forming an essential elastic force by the bow portion for enhancing a resilient clamping effect for efficiently clamping a daughter printed circuit board by two contacting protrusions of the contact element.

1 Claim, 3 Drawing Sheets

ELECTRICAL CONNECTOR FOR EXERTING MULTIPLE ELASTIC FORCES

BACKGROUND OF THE INVENTION

The earlier filed "Electrical Connector for Exerting Multiple Elastic Forces" discloses an electrical connector having a contact element formed with two spring arm members and two contacting protrusions disposed in a slot formed in a connector base for homogeneously exerting multiple elastic forces on the contact element for efficiently connecting a printed circuit board on the contact elements.

The first spring arm member 24 is secured to the pivot portion 23 protruding sidewardly towards a first side wall 12*a* in the slot 12 of the connector base 10. Such an arm member 24 secured to the base member 21 by the pivot portion 23 does not form as a bow shape and will not exert a very well elastic force between the first arm member 24 and the base member 21.

The second spring arm member 28 may be biased to bear against the second side wall 12*b* in the slot 12 when stably positioning a daughter board clamped by he contact element 2, to exert an elastic force between the second arm member 28 with the side wall 12*b* to possibly increase a clamping force of the contact element 2 for holding the daughter board 4 thereon. However, when it is intended to replace a daughter board by withdrawing the board 4 already clamped by the two protrusions 25, 27 of the contact element 2, the lower free end portion 282 of the second spring arm member 28 may be frictionally held on the side wall 12*b* to still keep an internal stress therein to thereby slow down the releasing of the board 4 from the contact element 2.

The second arm member 28 is so long which is easily obstructed by an external object or by the connector base 10 and can not be precisely embedded in the slot 12. If the arm member 28 is accidentally deformed, the protrusion 27 may be biased inwardly to reduce the aperture 2*a* between the two protrusions 27, 25, thereby influencing the clamping of the board 4. The deformed arm member 28 will also cause an assembly difficulty.

The present inventor has found the drawbacks of my earlier filed application, and invented the present electrical connector for overcoming the aforementioned drawbacks.

SUMMARY OF THE INVENTION

The object of the present invention is to provide an electrical connector having a contact element formed with a main spring arm member protruding inwardly from a side engaging member of the contact element embedded in a female hole formed in a connector base of the electrical connector defining a bow portion between the main spring arm member and the side engaging member for forming an essential elastic force by the bow portion for enhancing a resilient clamping effect for clamping a daughter printed circuit board by two contacting protrusions of the contact element.

DETAILED DESCRIPTION

Figure 1:
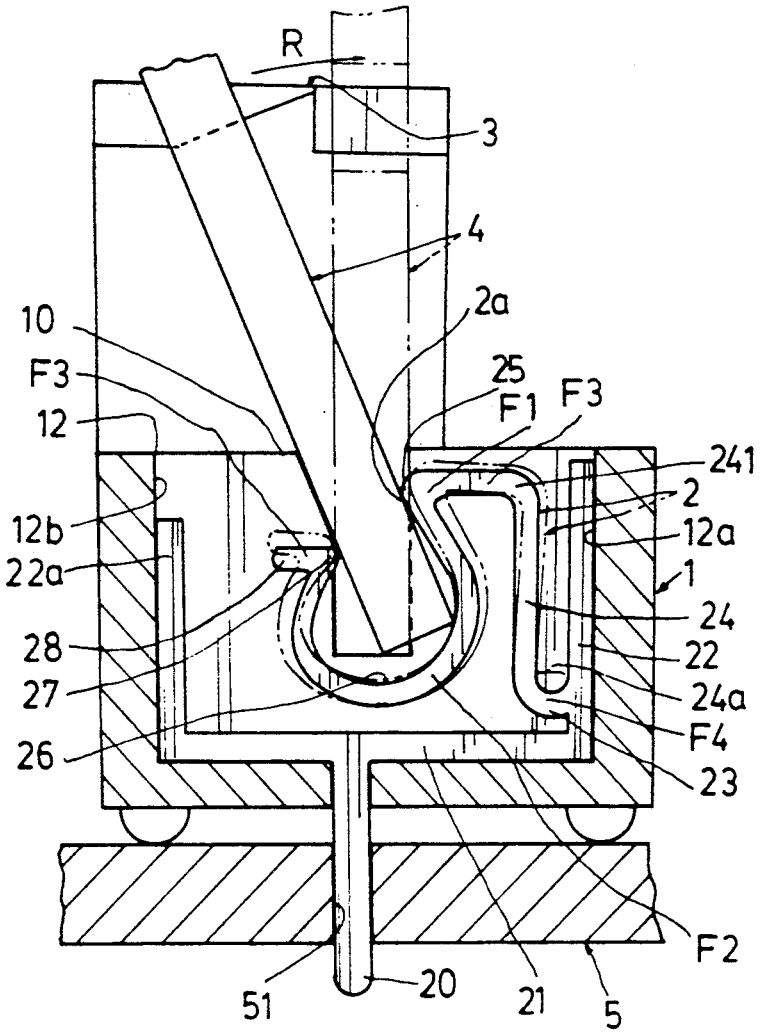
FIG. 1 is an illustration showing a contact element of the present invention embedded in a connector base for clamping a daughter board thereon.
Figure 2:
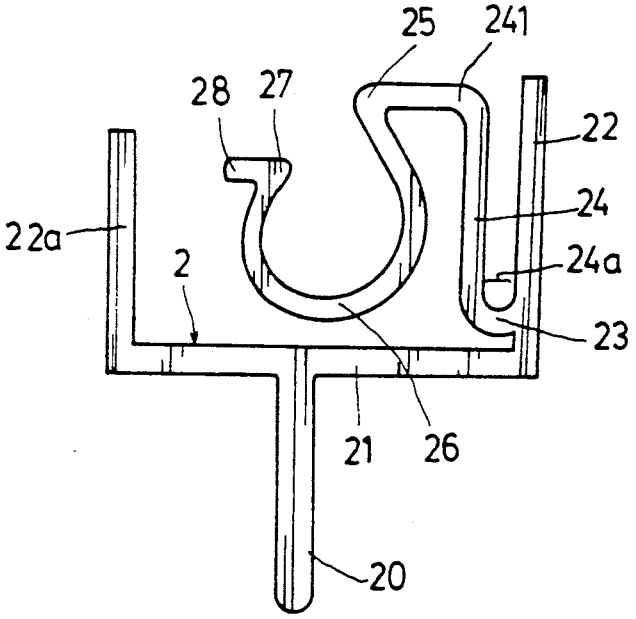
FIG. 2 shows the contact element of the present invention.

As shown in FIGS. 1 and 2, the electrical connector 1 of the present invention comprises: a connector base 10 generally formed as an elongate shape, a plurality of slots 12 juxtapositionally laterally formed in the base 10 for embedding a plurality of contact elements 2 therein, and a pair of latches 3 respectively formed on two opposite end portions of the elongate connector base 10 for locking a daughter printed circuit board 4 clamped by the contact elements 2 for electrically connecting the daughter board 4 to a mother printed circuit board 5 positioned under the electrical connector 1.

Each contact element 2 of the electrical connector 1 is made of electrically conductive material and includes: a base member 21 embedded in a bottom portion of the slot 12 formed in the connector base 10, a leg member 20 protruding downwardly from the base member 21 to be fixed into each leg hole 51 formed in the mother board 5, two side engaging members 22, 22*a* formed on two opposite end portions of the base member 21 respectively embedded with two side walls 21*a*, 12*b* of the slot 12 in the connector base 10, a main spring arm member 24 protruding inwardly from a pivot portion 23 secured to a first side engaging member 22 defining a bow portion 24*a* between the spring arm member 24 and the first side engaging member 22, a first contacting protrusion 25 formed as a convex portion adjacent to the main spring arm member 24, a concave linking member 26 concave downwardly from the first contacting protrusion 25, a second contacting protrusion 27 connected with the concave linking member 26 and formed as another convex portion for facing the first contacting protrusion 25 and defining an aperture 2*a* between the two protrusions 27, 25, and a short arm member 28 secured to the second contacting protrusion 27 and protruding sidewardly towards the second side wall 12*b* of the slot 12. The short arm member 28 will form the convex-shaped contacting protrusion 27 with a left portion of the linking member 26.

For mounting the daughter board 4 into the connector 1 of the present invention, the daughter board 4 is inclinedly inserted into the aperture 2*a* of the two contacting protrusions 25, 27 of the contact element as shown in FIG. 1. By biasing the board 4 in direction R to vertically erect the board 4 on the connector base 10 to be dotted line as shown in FIG. 1, the first contacting protrusion 25 will exert a first elastic force F1 on the convex portion of the first protrusion 25; then the concave linking member 26 will be transversely expanded to exert a second elastic force F2; and the short arm member 28, the recess linking member 26 and an upper portion 241 of the main arm member 24 will then be vertically raised to exert a third elastic force F3; and finally the main arm member 24 will be biased sidewardly about the bow portion 24*a* to exert a fourth elastic force F4.

The four elastic forces F1, F2, F3, and F4 will be synergetically added to increase a clamping force of the contact element 2 for efficiently clamping the daughter board 4 thereon for enhancing a good electrical connection among the daughter board 4, the contact element 2, and the mother board 5.

When it is intended to replace the daughter board 4 from the connector 1, the latches 3 are depressed to unlock the daughter board 4 on the connector 1, and each contact element 2 will release its elastic forces F1–F4 which are accumulated in the contact element during a clamping state of the board 4 as clamped in the contact element 2 to automatically recover the daughter board 4 to its original tilting inserting pose, causing an easy removal of the board 4 from the contact element 2.

The present invention is superior to my parent application earlier filed because of the following advantages:

1. The main spring arm member 24 forms a spring bow portion 24*a* with the first side engaging member 22 for exerting a strong elastic force which is greater than a spring force exerting at the pivot portion 23 of my prior filed application.

2. The short arm member 28 does not touch the second side wall 12*b* of the slot 12 to prevent a frictional holding of the arm member 28 with the side wall, so that after depressing the latches 3 to release the daughter board 4, the contact element 2 will soon restore the daughter board to its original tilting pose by releasing the energy of the elastic forces accumulated during a clamping state of the daughter board 4 clamped in the contact element 2.

3. The arm member 28 is made so short so that the contact element 2 will not be easily deformed or be obstructed by other articles, causing an easier assembly job and precise positioning or embedding of the contact element in the slot 12 of the connector base 10.

Figure 3:
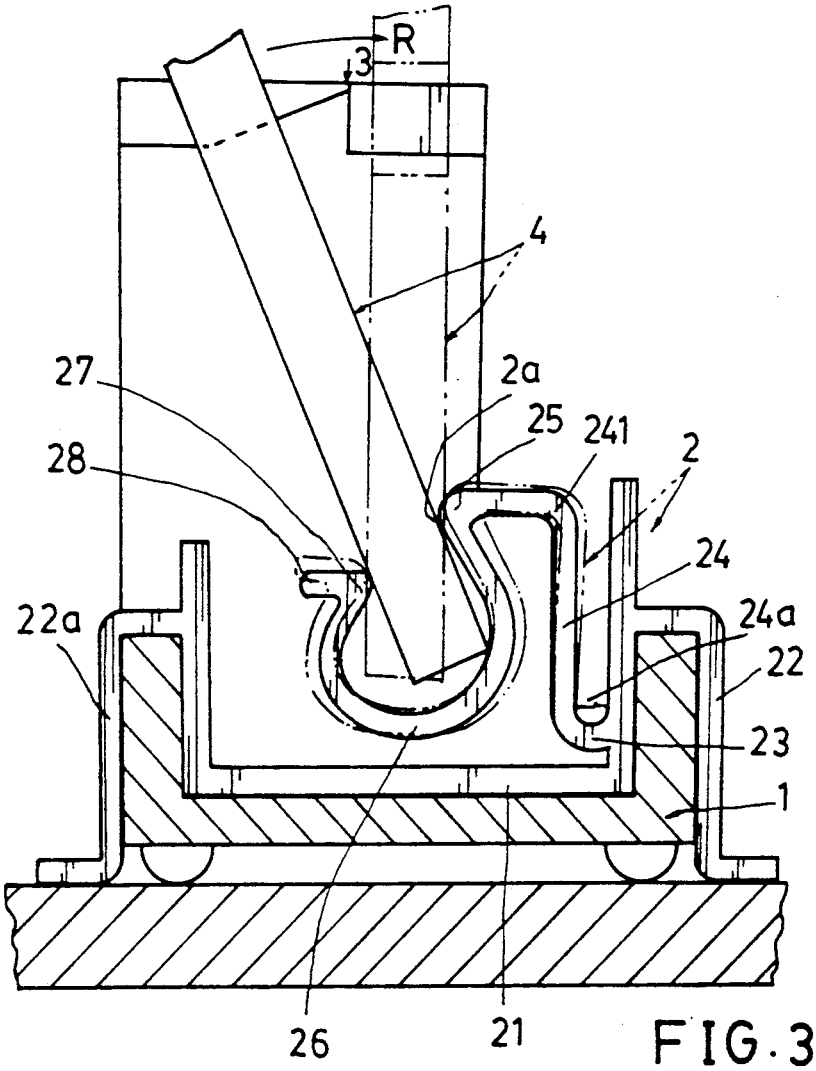
FIG. 3 is an illustration showing a contact element of the present invention when used in a surface mount technology.

A modification of the present invention to be used in a surface mount technology is shown in FIG. 3, in which two side engaging members 22, 22*a* are directly soldered on the mother board 5 and the leg member 20 as aforementioned is now omitted.

The main spring arm member 24 as aforesaid may also be designated as "the first spring arm member 24".

Figure 4:
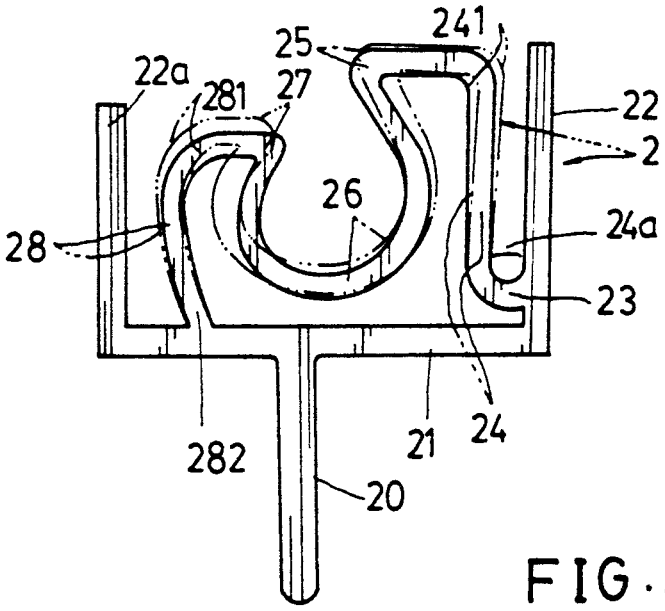
FIG. 4 shows another preferred embodiment of the present invention.

FIG. 4 shows a second protrusion 27 which is connected with a second spring arm member 28 at an upper portion 281 of the arm member 28 of which a lower portion 282 of the arm member 28 is secured to the base member 21.

Figure 5:
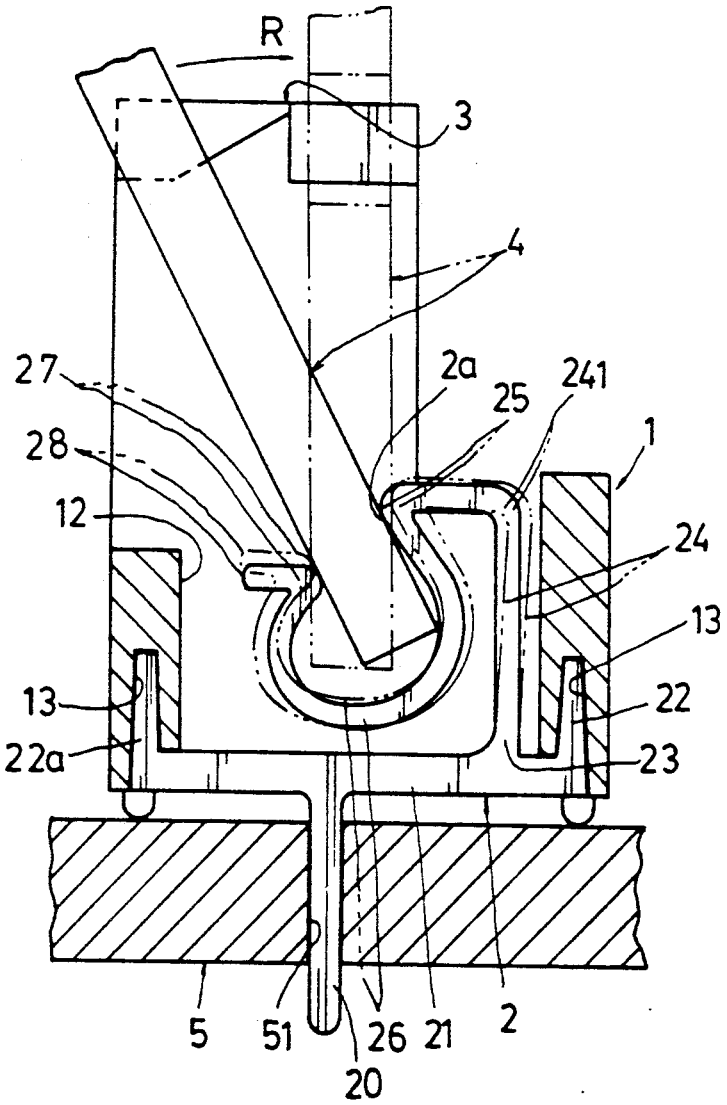
FIG. 5 shows still another preferred embodiment of the present invention.

FIG. 5 shows another preferred embodiment of the present invention by simplifying the bow portion 24*a* as aforementioned so that the main spring arm member 24 is directly protruded upwardly from the base member 21. Two engaging members 22, 22*a* are engaged into two female holes 13 formed in the connector base 10. Even the directly upwardly protruded arm member 24 as shown in FIG. 5 is previously disclosed in my parent application (FIG. 8, numeral 24) and is apparently obvious thereto. However, the short arm member 28 as disclosed in the modification as shown in FIG. 5 of this application is still novel and unobvious over my parent application in view of FIGS. 1–3 as aforementioned.

I claim:

1. An electrical connector comprises:

a connector base generally formed as an elongate shape, a plurality of slots juxtapositionally laterally formed in the base for embedding a plurality of contact elements in said slots, and a pair of latches respectively formed on two opposite end portions of the connector base for locking a daughter printed circuit board clamped by the contact elements for electrically connecting the daughter board to a mother printed circuit board positioned under said electrical connector;

each said contact element made of electrically conductive material including:

a base member embedded in a bottom portion of the slot formed in the connector base, a leg member protruding downwardly from the base member to be fixed into a leg hole formed in the mother board, two side engaging members respectively formed on two opposite end portions of the base member respectively embedded with two side walls of the slot in the connector base, a first spring arm member protruding inwardly from a pivot portion secured to a first side engaging member, a first contacting protrusion formed as a convex portion adjacent to he first spring arm member, a concave linking member concave downwardly from the first contacting protrusion, a second contacting protrusion connected with the concave linking member and formed as another convex portion for facing the first contacting protrusion and defining an aperture between the two protrusions, the improvement which comprises:

said first spring arm member forming a bow portion between the first spring arm member and the first side engaging member for exerting a strong elastic force from said bow portion; and said second contacting protrusion connected with a second spring arm member secured to said base member of said contact element.

* * * * *